US005518057A

United States Patent [19]

Huang

[11] Patent Number: 5,518,057

[45] Date of Patent: May 21, 1996

[54] SAFETY TASSEL FOR PULL CORDS

[75] Inventor: Chung-chen Huang, Taipei, Taiwan

[73] Assignee: Teh Yor Industrial Co., Ltd., Taipei, Taiwan

[21] Appl. No.: 359,786

[22] Filed: Dec. 20, 1994

[51] Int. Cl.[6] ..... E06B 9/38

[52] U.S. Cl. ..... 160/178.1; 160/320

[58] Field of Search ..... 160/178.1 R, 178.1 V, 160/168.1 R, 168.1 V, 173 R, 173 V, 320, 321; 24/136 R, 115 M, 115 F, 114.5, 136 L; 16/122

[56] References Cited

U.S. PATENT DOCUMENTS

| | | | |
|---|---|---|---|
| 4,782,560 | 11/1988 | Keller | 24/115 M |
| 4,909,298 | 3/1990 | Langhart et al. | 24/114.5 X |
| 4,967,824 | 11/1990 | Colson et al. | 160/178.1 R |
| 5,103,889 | 4/1992 | Ford | 160/178.2 V X |

*Primary Examiner*—David M. Purol

*Attorney, Agent, or Firm*—Pro-Techtor International

[57] ABSTRACT

An improved safety tassel for pull cords that includes a body provided with four cord-engaging slots. At least three of the cord-engaging slots are formed with radial slots having enlarged openings at divergent and convergent ends.

7 Claims, 2 Drawing Sheets

SAFETY TASSEL FOR PULL CORDS

FIELD OF THE INVENTION

This invention relates to an improved safety tassel for pull cords used for window coverings including venetian blinds and the like. The safety tassel is suitable with either two or four pulling cords in a set.

BACKGROUND OF THE INVENTION

Conventionally, in a tassel 1 for pull cords 2 for a venetian blind, as shown in FIG. 1, the ends of both cords 2 are knotted together so as to make the cords 2 fixed in the tassel 1. Little boys or girls may be accidentally injured if he or she is entangled in two cords 2 while playing.

In order to prevent children from being injured, a window covering cord pull safety device is provided in U.S. Pat. No. 4,909,298 wherein the safety device consists of two members retained by respective cords and detachably coupled together. This device does not teach the use of a set of four pull cords.

Further, U.S. patent application Ser. No. 08/302,306 filed on Sep. 8, 1994, and assigned to the same assignee of this application, discloses a safety tassel for pull cords comprising fixed engaging means and removable engaging means, the latter having enlarged openings at radially divergent ends so that the relevant cord can be removed from the tassel when necessary. It has been found that this safety tassel is very effective for a set of two cords, but not as effective for a set of four cords if the cords are entangled with each other.

SUMMARY OF THE INVENTION

It is, therefore, the primary object of the present invention to provide an improved safety tassel for pull cords which are effective with either two or four cords in a set. When any little child is entangled between or among the cords, said cords will be automatically and effectively released to prevent the child from being injured.

This object is accomplished according to the invention with an improved safety tassel for pull cords comprising a body provided with four cord-engaging means, in which at least three are formed with respective radially extended slots having enlarged openings at both divergent and convergent ends.

The aforementioned and other objects, features and advantages will be understood by the following detailed description in connection with the accompanying drawings in which like reference symbols designate like parts throughout the figures.

DETAILED DESCRIPTION OF THE PREFERRED EMBODIMENTS

Figure 1:
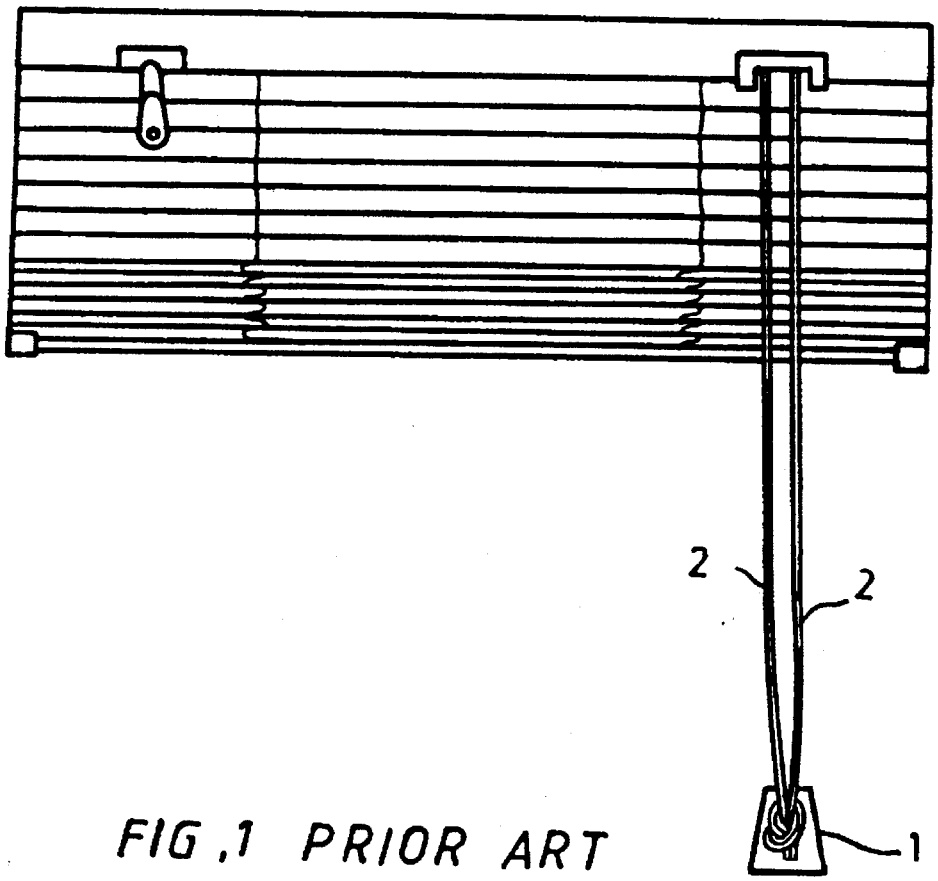
FIG. 1 PRIOR ART
FIG. 1 is a front broken view of the conventional tassel for pull cords used in a venetian blind.
Figure 2:
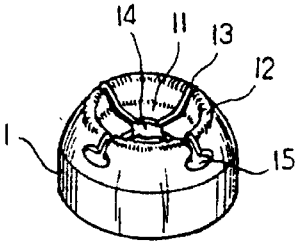
FIG. 2 is a perspective view of the safety tassel according to the first embodiment of the present invention.
Figure 3:
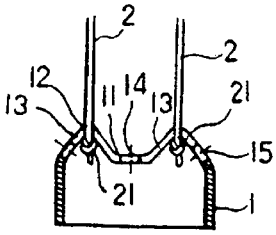
FIG. 3 is a cross section view of the first embodiment with the cords engaged therein.
Figure 4:
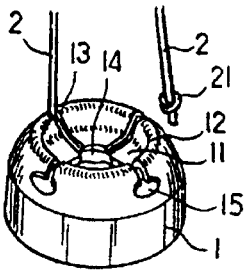
FIG. 4 shows the tassel with one of the cords pulled off.

Reference is first made to FIGS. 2 to 4, which illustrate type safety tassel for pull cords according to the first embodiment of the present invention. The present tassel has a hollow body 1 in the configuration or an inverted cup, although main configurations are feasible. The body 1 is closed at an upper side and opened at a bottom side. Of course, said bottom side can be alternatively closed too. A central recess 11 is formed on the top side with a circular ridge 12 raised in relation to said recess 11 along the periphery. A corresponding annular dome under said ridge 12 is formed circumferentially inside of the body 1. So long as said dome is formed internally it is not necessary to have the recess 11 at the external surface. In other words, it may be thickened, for example, at a top central portion of said body 1 to the extent that a flat surface is formed.

As cord-engaging means, four radial slots 13 are formed, extending in directions orthogonal to each other. Both the convergent and divergent ends of each slot 13 include enlarged openings 14 and 15. The opening 14 at the convergent end of each slot 13 terminates at the center of the recess 11, so that all openings 14 of the four slots 13 are identical to each other and, in effect, becoming one common opening 14.

Two or four pulling cords 2 (two are shown in this embodiment) are passed through respective slots 13 and knotted at the end 21 thereunder. The size of the knotted end 21 is of course greater than the transverse width of said slot end 21 is of course greater than the transverse width of said slot 13 os that the knotted end 21 is positively retained inside the body 1. The knotted end 21 is smaller than the diameters of either convergent or divergent end openings 14 and 15, respectively. The width of each slot 13 is preferably about the same size as the cross section of said cord 2 or even slightly smaller to restrict the cord from being arbitrarily displaced within the slot 13. Since the distance between any two slots 13 is much less than the normal size of a human neck, if a child becomes entangled between any two or among more than two of the cords 2, said cords 2 are displaced towards the divergent end openings 15 and automatically released. Even if any of the cord 2, most possibly diametrically opposite cords 2, would become entangled in an abnormal state, such that said entangled cords 2 would probably not be displaced towards the divergent ends of said slots 13, but rather in the opposite direction toward the convergent ends of said slots 13, then the cords 2 under this circumstance are still readily displaced through the convergent end opening 14 and released. Therefore, in any accidental situation the cords 2 are assured of being released or detached from the body 1 to prevent themselves from causing injury to the child.

Figure 5:
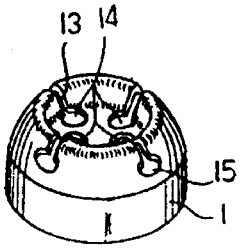
FIG. 5 is a perspective view of the safety tassel according to the second embodiment of the present invention.
Figure 6:
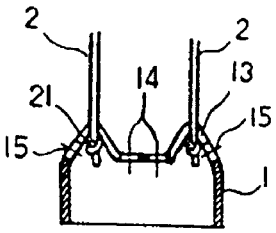
FIG. 6 is a cross section view of the second embodiment.

The openings 14 at convergent ends of said slots 13 can be independent as shown in the second embodiment illustrated in FIGS. 5 and 6. The action and effect are substantially the same as described above in conjunction with the first embodiment shown in FIGS. 2 to 4.

Figure 7:
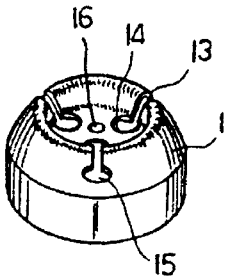
FIG. 7 is a perspective view of the safety tassel according to the third embodiment.
Figure 8:
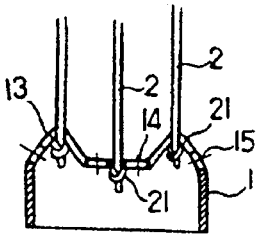
FIG. 8 is a cross section view of the third embodiment.

Further, a third embodiment is illustrated in FIGS. 7 and 8. In comparison with the second embodiment, it is seen that one of the four cord-engaging means, i.e. the slots 13, is replaced by a central hole 16, and other three slots 3 are angularly spaced apart. In this embodiment the cord 2 that is passed through said hole 16 and knotted at 21 thereunder would be still retained and not released under pressure. Since the other three cords 2 that pass through said three slots will be detached just the same as decried with reference to the aforementioned first and second embodiments, only one cord 2 is retained in the body 1, and cannot cause any harm to the child.

While there have been shown and described what are presently considered preferred embodiments of the invention, it will be obvious to those skilled in the art what a number of changed and variations may be made without departing from the scope of this invention as defined by the appended claims.

What I claim is:

1. An improved safety tassel for pull cords, comprising;

a hollow body with a plurality of cord-engaging means formed on a top surface of said body, wherein at least three of said cord-engaging means are radial slots that extend through a raised periphery of said top surface, said slots are formed with enlarged openings at both convergent and divergent ends.

2. The safety tassel of claim 1, wherein;

at least four of said cord-engaging means are radial slots, so that four slots extend radially at ninety degree intervals.

3. The safety tassel of claim 2, wherein;

said openings at said convergent ends of said slots combine to form one common opening.

4. The safety tassel of claim 2, wherein;

said openings at said convergent ends of said slots are independent of each other.

5. The safety tassel of claim 1, wherein;

one of said cord-engaging means is in the form of a central hole.

6. The safety tassel of claim 1, wherein;

said body is formed with a central recess on said top surface.

7. The safety tassel of claim 1, wherein;

said body has a configuration of an inverted cup.

* * * * *